US011952640B2

(12) United States Patent
Umemori et al.

(10) Patent No.: US 11,952,640 B2
(45) Date of Patent: Apr. 9, 2024

(54) STEEL FOR A MOLD AND MOLD

(71) Applicant: DAIDO STEEL CO., LTD., Nagoya (JP)

(72) Inventors: Naoki Umemori, Nagoya (JP); Toshifumi Nemoto, Nagoya (JP)

(73) Assignee: DAIDO STEEL CO., LTD., Nagoya (JP)

( * ) Notice: Subject to any disclaimer, the term of this patent is extended or adjusted under 35 U.S.C. 154(b) by 0 days.

(21) Appl. No.: 18/111,381

(22) Filed: Feb. 17, 2023

(65) Prior Publication Data

US 2023/0265535 A1 Aug. 24, 2023

(30) Foreign Application Priority Data

Feb. 24, 2022 (JP) ..... 2022-026456

(51) Int. Cl.

| | |
|---|---|
| ***C21D 9/00*** | (2006.01) |
| ***C21D 1/18*** | (2006.01) |
| ***C21D 6/00*** | (2006.01) |
| ***C22C 33/04*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(Continued)

(52) U.S. Cl.

CPC ..... *C21D 9/00* (2013.01); *C21D 1/18* (2013.01); *C21D 6/004* (2013.01); *C21D 6/005* (2013.01);

(Continued)

(58) Field of Classification Search

None

See application file for complete search history.

(56) References Cited

U.S. PATENT DOCUMENTS 6,024,916 A * 2/2000 Urita ..... C21D 6/002 420/110

2010/0132429 A1 6/2010 Murakami et al.

(Continued)

FOREIGN PATENT DOCUMENTS

CN 103276298 A 9/2013

JP H 02-011736 A 1/1990

(Continued)

OTHER PUBLICATIONS

Taiwanese Office Action, dated Oct. 11, 2023 in Taiwanese Patent Application No. 112106581 and it's English Translation.

(Continued)

*Primary Examiner* — Jenny R Wu

(74) *Attorney, Agent, or Firm* — MCGINN I.P. LAW GROUP, PLLC.

(57) ABSTRACT

The present invention relates to a steel for a mold including: on % by mass basis, 0.55%≤C≤0.70%; 0.30%≤Si≤0.60%; 0.55%≤Mn≤1.2%; 5.7%≤Cr≤6.9%; 1.2%≤Mo+W/2≤1.6%; 0.55%≤V≤0.79%; and 0.005%≤N≤0.1%, with the remainder being Fe and inevitable impurities including, Al≤0.020%, Ni≤0.20%, S≤0.0015%, and Cu≤0.10%, and satisfying P1≥24 and 4.9≤P2≤7.3, P1 and P2 being a value obtained based on the following formula (1) and (2), respectively, P1=45−13.6[Si]−7.0([Mo]+[W]/2)−12.9[Ni] (1), P2=7.4[V]+15.8[N]+38.6[Al] (2) in which [M] represents a content of an element M in % by mass basis, and relates to a mold including the steel for a mold.

8 Claims, 4 Drawing Sheets

(51) Int. Cl.

| | |
|---|---|
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/52*** | (2006.01) |

(52) U.S. Cl.
CPC ..... *C21D 6/007* (2013.01); *C21D 6/008* (2013.01); *C22C 33/04* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/52* (2013.01)

(56) References Cited

U.S. PATENT DOCUMENTS

| | | | |
|---|---|---|---|
| 2015/0044087 | A1 | 2/2015 | Ayabe et al. |
| 2018/0135144 | A1* | 5/2018 | Shouji ..... C22C 38/00 |

FOREIGN PATENT DOCUMENTS

| | | | | |
|---|---|---|---|---|
| JP | H 04-308059 | A | | 10/1992 |
| JP | 2000-212699 | A | | 8/2000 |
| JP | 2000-212700 | A | | 8/2000 |
| JP | 2001-049394 | A | | 2/2001 |
| JP | 2001-064754 | A | | 3/2001 |
| JP | 2003226939 | A | * | 8/2003 |
| JP | 2005226150 | A | * | 8/2005 |
| JP | 3838928 | B2 | * | 10/2006 |
| JP | 2015-040315 | A | | 3/2015 |
| JP | 6977414 | B2 | | 12/2021 |
| TW | 201404888 | A | | 2/2014 |

OTHER PUBLICATIONS

Extended European search report in European Application No. 23157918.6 dated Jul. 14, 2023.

* cited by examiner

STEEL FOR A MOLD AND MOLD

CROSS-REFERENCE TO RELATED APPLICATIONS

This application is based on and claims priority under 35 USC 119 from Japanese Patent Application No. 2022-026456 filed on Feb. 24, 2022, the contents of which are incorporated herein by reference.

TECHNICAL FIELD

The present invention relates to a steel for a mold and a mold, and more particularly to a steel for a mold used to constitute a mold such as a hot stamping mold, and such a mold.

BACKGROUND ART

In a steel for a mold constituting a mold for processing a steel material by press molding or the like, from the viewpoint of improving the wear resistance and the thermal shock resistance of the mold, it is desired that the steel for a mold has high hardness and toughness. In a mold used under high temperature conditions such as warm molding, hot stamping, warm trimming, and piercing, it is particularly important to improve the wear resistance and the thermal shock resistance thereof. For example, Patent Literature 1 discloses a hot work tool steel including, in terms of weight %, more than 0.35% and less than 0.45% of C, 1.00% or less of Si, 0.1% to 1.5% of Mn, 0.1% to 1.5% of Ni, 4.35% to 5.65% of Cr, 1.5% to 3.5% of one or two of W and Mo in terms of W/2+Mo, 0.5% to 1.5% of V, amounts of Si and Cr satisfying a relational expression of $Si<(18.7/Cr)-3.3$, and the balance being Fe and inevitable impurities. This hot work tool steel is considered to have high toughness in a high hardness range. Further, Patent Literature 2 discloses a tool steel for warm working and hot working including, in terms of weight %, 0.45% or more and less than 0.65% of C, 0.60% or less of Si, 1.50% or less of Mn, 3.00% to 5.50% of Cr, 2.00% to 3.50% of one or two of W and Mo in terms of W/2+Mo, 0.80% to 1.60% of V, 0.30% to 5.00% of Co, 0.005% or less of S, and the balance being Fe and inevitable impurities. The tool steel is considered to be excellent in high-temperature strength and toughness.

Patent Literature 1: JPH04-308059A

Patent Literature 2: JPH02-11736A

SUMMARY OF INVENTION

In the hot work tool steel disclosed in Patent Literature 1, the hardness is 54 HRC at the maximum. With this hardness, it may be difficult to ensure sufficiently high wear resistance as a steel for a mold. It is considered that it is difficult to obtain high hardness in the hot work tool steel of Patent Literature 1 because contents of C and Cr are relatively small. In the case where the content of C is increased, the hardness of the steel for a mold can be improved, but as the hardness is increased, coarse carbides such as crystallized carbides are likely to be generated, and the toughness is likely to be reduced even in the case where high hardness is obtained. In addition, in order to improve the thermal shock resistance, it is also considered to be effective to make it difficult to apply a large shock due to local heating to a surface of the mold by improving the thermal conductivity in addition to improving the toughness of the steel for a mold, but the improvement of the thermal conductivity is not considered in Patent Literatures 1 and 2.

An object of the present invention is to provide a steel for a mold having excellent wear resistance and thermal shock resistance, and a mold.

In order to solve the above problems, the steel according to the present invention is a steel for a mold including: on % by mass basis, $0.55\%\leq C\leq 0.70\%$; $0.30\%\leq Si\leq 0.60\%$; $0.55\%\leq Mn\leq 1.2\%$; $5.7\%\leq Cr\leq 6.9\%$; $1.2\%\leq Mo+W/2\leq 1.6\%$; $0.55\%\leq V\leq 0.79\%$; and $0.005\%\leq N\leq 0.1\%$, with the balance being Fe and inevitable impurities including, on % by mass basis, $Al\leq 0.020\%$, $Ni\leq 0.20\%$, $S\leq 0.0015\%$, and $Cu\leq 0.10\%$, and satisfying $P1\geq 24$ and $4.9\leq P2\leq 7.3$, P1 being a value obtained based on the following formula (1) and P2 being a value obtained based on the following formula (2), $P1=45-13.6[Si]-7.0([Mo]+[W]/2)-12.9[Ni]$ (1), $P2=7.4[V]+15.8[N]+38.6[Al]$ (2) in the formulae (1) and (2), [M] represents a content of an element M in % by mass basis.

In a state after quenching and tempering, the steel for a mold preferably has a hardness at room temperature of 58 HRC or more and 61 HRC or less, and a thermal conductivity at room temperature of 20 W/(m·K) or more.

The steel for a mold may further comprise, on % by mass basis, at least one kind selected from the group consisting of $0.01\%\leq Nb\leq 0.5\%$, $0.01\%\leq Zr\leq 0.5\%$, and $0.01\%\leq Ta\leq 0.5\%$. The steel for a mold may further comprise, on % by mass basis, $0.10\%\leq Co\leq 1.0\%$.

The steel for a mold, in a state after quenching, preferably has a crystal grain size of 5 or more in terms of a grain size number defined in JIS G 0551:2020. The steel for a mold, in a state after quenching and tempering, preferably has a grain size of a crystallized carbide of less than 25 μm.

The mold according to the present invention is a mold including the steel for a mold.

The mold may be a hot stamping mold.

The steel for a mold according to the present invention has both high hardness and high thermal conductivity by including the above-mentioned component composition, and generation of coarse carbides and coarsening of crystal grains are prevented. As a result, the steel for a mold achieves both high wear resistance and high thermal shock resistance at a high degree. In particular, in the case where satisfying $P1\geq 24$, a high thermal conductivity improvement effect is obtained. In addition, in the case where satisfying $4.9\leq P2\leq 7.3$, a high effect of improving the toughness due to refinement of crystal grains is obtained. As a result, a steel for a mold having particularly excellent thermal shock resistance is obtained. Limiting contents of Al, Ni, S, and Cu to a predetermined upper limit or less also contributes to improvement in thermal shock resistance. Further, by adopting the above-mentioned component composition, it is possible to provide a mold excellent in wear resistance and thermal shock resistance while limiting contents of the additive alloy elements to be relatively small and eliminating a process with high manufacturing cost such as powder molding.

Here, in the steel for a mold, in the case where the hardness at room temperature is 58 HRC or more and 61 HRC or less and the thermal conductivity at room temperature is 20 W/(m·K) or more in a state after quenching and tempering, a high hardness sufficient for improving the wear resistance can be achieved, generation of coarse crystallized carbides and coarsening of crystal grains due to application of a component composition giving excessive high hardness, and a decrease in toughness associated therewith can be prevented, and high thermal shock resistance can be ensured. In addition, since the steel for a mold has a sufficiently high thermal conductivity, it is possible to prevent an increase in the surface temperature of the mold, alleviate concentration of heat on the surface, and thereby enhancing the thermal shock resistance.

In the case where the steel for a mold further includes at least one kind selected from the group consisting of Nb, Zr, and Ta at the above-mentioned specific amount, the toughness of the steel for a mold can be particularly enhanced.

In the case where the steel for a mold further includes the above-mentioned specific amount of Co, the high-temperature strength of the steel for a mold is improved.

In the case where the steel for a mold has a crystal grain size of 5 or more in terms of a grain size number defined in JIS G 0551:2020 in a state after quenching, or in the case where the steel for a mold has a grain size of a crystallized carbide of less than 25 μm in a state after quenching and tempering, the thermal shock resistance of the steel for a mold can be particularly easily enhanced by preventing the generation of coarse crystallized carbides.

Since the mold according to the present invention includes the steel for a mold as described above, the mold is excellent in wear resistance and thermal shock resistance. Since the mold has these characteristics, the mold can be suitably used particularly as a hot stamping mold.

DESCRIPTION OF EMBODIMENTS

Figure 1:
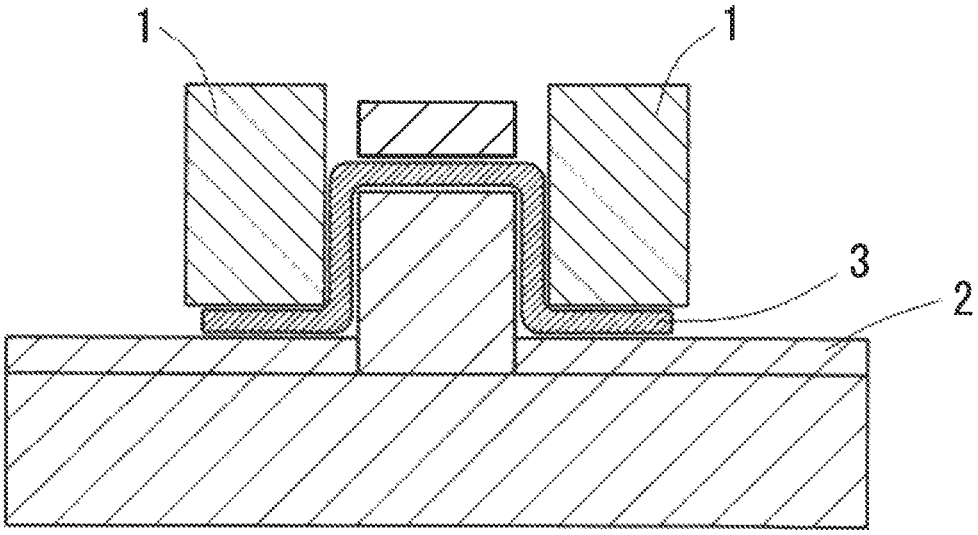
FIG. 1 is a schematic cross-sectional view illustrating a hat bending test for evaluating the wear resistance.

Hereinafter, a steel for a mold and a mold according to an embodiment of the present invention will be described in detail.

The steel for a mold according to an embodiment of the present invention includes the following elements, with the balance being Fe and inevitable impurities. The types, component ratios, reasons for limitation, and the like of additive elements are as follows. A unit of the component ratios is % by mass. Hereinafter, unless otherwise specified, each characteristic is a value evaluated at room temperature (approximately 25° C.). Characteristics to be evaluated for a state after a heat treatment are evaluated after quenching at a cooling rate of 9° C./min to 100° C./min from a quenching temperature (for example, 1,030° C.±20° C.) to 200° C., and tempering at 500° C. to 600° C.

[Content of Each Component Element]

0.55%≤C≤0.70%

C dissolves in a matrix phase at the time of quenching and forms a martensite structure, thereby improving the hardness of the steel for a mold. In addition, C also improves the hardness of the steel for a mold by forming carbides together with Cr, Mo, V, and the like.

By setting the content of C to satisfy 0.55%≤C, a solid solution amount of C and a generation amount of the carbides can be ensured, and high hardness is obtained. From the viewpoint of obtaining sufficient wear resistance, the steel for a mold preferably has a hardness of 58 HRC or more through quenching and tempering, but in the case where satisfying 0.55%≤C, a high hardness of 58 HRC or more is easily achieved. Preferably, the content of C may satisfy 0.57%≤C.

On the other hand, in the case where the content of C is excessive, coarse carbides are likely to increase, and the toughness of the steel for a mold is likely to decrease. In addition, the thermal conductivity is also likely to be reduced. As a result, it is difficult to obtain high thermal shock resistance in the steel for a mold. In the case where satisfying C≤0.70%, generation of coarse carbides is prevented and high thermal conductivity is ensured, and thus high thermal shock resistance is obtained. In an alloy composition giving excessively high hardness, generation of coarse carbides and a decrease in thermal conductivity are likely to occur, and therefore, in the steel for a mold, it is preferable that the hardness is limited to 61 HRC or less through quenching and tempering. In the case where satisfying C≤0.70%, the hardness is limited to 61 HRC or less, and high thermal shock resistance is easily ensured. Preferably, the content of C may satisfy C≤0.65%. More preferably, the content of C may satisfy C≤0.64%.

0.30%≤Si≤0.60%

Si increases the hardness of the steel for a mold, and the effect of improving the hardness can be sufficiently obtained in the case where satisfying 0.30%≤Si. Si also has an effect as a deoxidizing agent and an effect of improving machinability at the time of manufacturing a mold. Preferably, the content of Si may satisfy 0.40%≤Si. More preferably, the content of Si may satisfy 0.42%≤Si.

On the other hand, in the case where the content of Si is excessive, the thermal conductivity of the steel for a mold decreases. In addition, coarse crystallized carbides are likely to be generated. Therefore, Si is set to satisfy Si≤0.60% from the viewpoint of ensuring high thermal conductivity and preventing the generation of coarse crystallized carbides. Preferably, the content of Si may satisfy Si≤0.55%.

0.55%≤Mn≤1.2%

Mn has an effect of enhancing the quenching property of the steel for a mold. In addition, Mn is also effective to enhance the toughness of the steel for a mold. From the viewpoint of obtaining high quenching property and toughness, the content of Mn is set to satisfy 0.55%≤Mn. Preferably, the content of Mn may satisfy 0.70%≤Mn. More preferably, the content of Mn may satisfy 0.75%≤Mn.

On the other hand, Mn is an element that reduces the thermal conductivity of the steel for a mold. Therefore, from the viewpoint of ensuring high thermal conductivity, the content of Mn is set to satisfy Mn≤1.2%. Preferably, the content of Si may satisfy Mn≤1.1%.

5.7%≤Cr≤6.9%

Cr has an effect of increasing the hardness of the steel for a mold. Similar to Mn, Cr has an effect of enhancing the quenching property and the toughness of the steel for a mold. From the viewpoint of obtaining high hardness, quenching property, and toughness, the content of Cr is set to satisfy 5.7%≤Cr. Preferably, the content of Cr may satisfy 5.9%≤Cr.

On the other hand, similar to Mn, Cr also reduces the thermal conductivity of the steel for a mold. Therefore, from the viewpoint of ensuring high thermal conductivity, the content of Cr is set to satisfy Cr≤6.9%. Preferably, the content of Cr may satisfy Cr≤6.7%. More preferably, the content of Cr may satisfy Cr≤6.5%.

1.2%≤Mo+W/2≤1.6%

Mo and W contribute to increasing the hardness of the steel for a mold by forming a secondary carbide. From the viewpoint of ensuring high hardness desired for the steel for a mold, the contents of Mo and W are set to satisfy 1.2%≤Mo+W/2 in terms of the sum (Mo+W/2) of the content of Mo and the half of the content of W. As a result, a high hardness of 58 HRC or more is easily achieved. Preferably, the contents of Mo and W may satisfy 1.3%≤Mo+W/2. More preferably, the contents of Mo and W may satisfy 1.32%≤Mo+W/2.

On the other hand, Mo and W are elements that reduce the thermal conductivity of the steel for a mold. In addition, Mo and W are expensive elements, and in the case where Mo and W are contained in a large amount in the steel for a mold, the material cost increases. From the viewpoint of ensuring high thermal conductivity and reducing the material cost, the contents of Mo and W are set to satisfy Mo+W/2≤1.6%. Preferably, the contents of Mo and W may satisfy Mo+W/2≤1.55%.

0.55%≤V≤0.79%

V generates pinning particles that prevent coarsening of crystal grains at the time of quenching. As a result of preventing the coarsening of crystal grains, the toughness of the steel for a mold is improved. In the case where satisfying 0.55%≤V, the coarsening of crystal grains at the time of quenching is effectively prevented, and the toughness is enhanced. Preferably, the content of V may satisfy 0.57%≤V.

On the other hand, in the case where the content of V is too large, a large amount of coarse carbides is precipitated. The coarse carbides do not contribute to the improvement in hardness. In addition, since a coarse carbide is a starting point of a crack, the toughness of the steel for a mold is rather reduced. Therefore, from the viewpoint of preventing generation of coarse carbides, V is set to satisfy V≤0.79%. Preferably, the content of V may satisfy V≤0.75%. More preferably, the content of V may satisfy V≤0.72%.

0.005%≤N≤0.1%

N generates nitrides having a pinning effect of preventing the coarsening of crystal grains at the time of quenching. By preventing the coarsening of crystal grains at the time of quenching, the toughness of the steel for a mold is improved. In addition, the nitrides also act as nuclei of a crystallized carbide, and have an effect of refining the crystallized carbide by finely dispersing and forming the nuclei. From the viewpoint of sufficiently obtaining these effects, N is set to satisfy 0.005%≤N. Preferably, the content of N may satisfy 0.01%≤N.

On the other hand, in the case where the content of N is too large, the nitrides aggregate, and the pinning particles become large. As a result, the crystal grains become coarse. In addition, the nitride as the nucleus of the crystallized carbide is aggregated, and the crystallized carbide becomes large. From the viewpoint of avoiding coarsening of crystal grains and generation of coarse crystallized carbides, N is set to satisfy N≤0.1%. Preferably, the content of N may satisfy N≤0.05%. More preferably, the content of N may satisfy N≤0.03%.

The steel for a mold according to the present embodiment includes C, Si, Mn, Cr, V, N, and at least one of Mo and W at the above-mentioned predetermined amounts, and the remainder includes Fe and inevitable impurities. Here, Al, Ni, S, and Cu may be included as the inevitable impurities, and the contents thereof are limited within the following range.

Al≤0.020%

Al easily forms coarse inclusions in the steel for a mold, and reduces the thermal shock resistance. From the viewpoint of preventing generation of inclusions and ensuring high thermal shock resistance, Al is not added to the steel for a mold and only included as an inevitable impurity, and the content thereof is limited to 0.020% or less. Preferably, the content may be 0.015% or less. More preferably, the content may be 0.010% or less.

Ni≤0.20%

Ni reduces the thermal conductivity of the steel for a mold. From the viewpoint of ensuring high thermal conductivity, Ni is not added to the steel for a mold and only included as an inevitable impurity, and the content thereof is limited to 0.20% or less. Preferably, the content may be 0.16% or less. More preferably, the content may be 0.13% or less.

S≤0.0015%

Similar to Al, S also easily forms coarse inclusions in the steel for a mold, and reduces the thermal shock resistance. From the viewpoint of preventing generation of inclusions and ensuring high thermal shock resistance, S is not added to the steel for a mold and only included as an inevitable impurity, and the content thereof is limited to 0.0015% or less. Preferably, the content may be 0.0012% or less. More preferably, the content may be 0.0010% or less.

Cu≤0.10%

Similar to Ni, Cu also reduces the thermal conductivity of the steel for a mold. From the viewpoint of ensuring high thermal conductivity, Cu is not added to the steel for a mold and only included as an inevitable impurity, and the content thereof is limited to 0.10% or less. Preferably, the content may be 0.08% or less. More preferably, the content may be 0.06% or less.

Examples of inevitable impurities other than Al, Ni, S, and Cu that can be included in the steel for a mold according to the present embodiment include P<0.05%, O<0.01%, Co<0.10%, Nb<0.01%, Ta<0.01%, Ti<0.01%, Zr<0.01%, B<0.001%, Ca<0.001%, Se<0.03%, Te<0.01%, Bi<0.01%, Pb<0.03%, Mg<0.02%, and Rare Earth Metal (REM) <0.10%.

The steel for a mold according to the present embodiment may optionally include one or more elements selected from the following elements in addition to the above-described essential elements. Component ratios, reasons for limitation, and the like of respective elements are as follows.

0.01%≤Nb≤0.5%, 0.01%≤Zr≤0.5%, 0.01%≤Ta≤0.5%

Nb, Zr, and Ta generate precipitates that act as pinning particles that prevent the coarsening of crystal grains at the time of quenching. The coarsening of the crystal grains at the time of quenching is prevented and the crystal grains become fine grains, whereby the toughness of the steel for a mold is improved. The lower limit value of the content of each element is defined as a content at which precipitates are obtained in an amount sufficient to exhibit the pinning effect. The upper limit value is defined from the viewpoint of preventing the precipitates from aggregating and not effectively functioning as pinning particles.

0.10%≤Co≤1.0%

Co has an effect of improving the strength, particularly the high-temperature strength, of the steel for a mold. The lower limit value of the content is defined as a content at which an effect of improving the high-temperature strength is obtained. The upper limit value is defined from the viewpoint of preventing a decrease in the thermal conductivity and reducing the material cost.

[Relation Between Contents of Component Elements]

Next, the relationship between the contents of the component elements will be described. Hereinafter, in a mathematical formula defining the relationship between the contents of the component elements, [M] indicates the content of an element M in % by mass basis. In addition, in the case where an element that is not an essentially included element is not included in the steel for a mold, the content thereof in the mathematical formula is set to zero.

P1≥24

P1 is obtained based on the following formula (1).

$$P1=45-13.6[Si]-7.0([Mo]+[W]/2)-12.9[Ni] \quad (1)$$

All of Si, Mo, W, and Ni included in the formula (1) reduce the thermal conductivity by solid solution in the steel for a mold. By limiting the contents of these elements to be small and increasing the value of P1, high thermal conductivity is obtained. In the following examples as well, it is confirmed that the thermal conductivity tends to increase as P1 increases (see FIG. 2). In the case where P1≥24, a high thermal conductivity of 20 W/(m·K) or more is easily achieved. Preferably, P1 may satisfy P1≥25. More preferably, P1 may satisfy P1≥26. In the steel for a mold, it is preferable that the thermal conductivity is higher, so that an upper limit is not particularly set for the value of P1 as long as each of Si, Mo+W/2, and Ni does not fall below the individual lower limit values described above.

4.9≤P2≤7.3

P2 is obtained based on the following formula (2).

$$P2=7.4[V]+15.8[N]+38.6[Al] \quad (2)$$

All of V, N, and Al included in the formula (2) contribute to generation of pinning particles that prevent the coarsening of crystal grains at the time of quenching, such as carbonitrides and nitrides. As a result of preventing the coarsening of crystal grains, the toughness of the steel for a mold is improved. In the case where satisfying 4.9%≤P2, the coarsening of crystal grains at the time of quenching is effectively prevented, and the toughness is enhanced. Preferably, P2 may satisfy 5.0≤P2. More preferably, P2 may satisfy 5.2≤P2.

On the other hand, in the case where the contents of V, N, and Al are too large, a large amount of coarse precipitates is precipitated. The coarse precipitates hardly contribute as pinning particles, and the generation of coarse crystal grains cannot be effectively prevented. In addition, coarse crystallized carbides and inclusions are easily generated. As a result, the toughness of the steel for a mold is reduced. Therefore, from the viewpoint of preventing these phenomena, P2 is set to satisfy P2≤7.3. Preferably, P2 may satisfy P2≤7.0. More preferably, P2 may satisfy P2≤6.5. As shown in the following examples (see FIG. 3), in the case where P2 is too small or too large, P2 does not effectively contribute to the prevention of the generation of coarse crystal grains due to the generation of pinning particles, but in the case where satisfying 4.9≤P2≤7.3, it is easy to achieve refinement of crystal grains in which a crystal grain size of 5 or more in terms of the grain size number specified in JIS G 0551:2020 (hereinafter, the same applies to the grain size number) is obtained in a state after quenching.

[Characteristics of Steel for Mold]

Since the steel for a mold according to the present embodiment includes the above-described component composition, both high wear resistance and high thermal shock resistance are achieved. Specifically, since the steel for a mold exhibits high hardness after being subjected to heat treatment, high wear resistance is obtained. At the same time, the steel for a mold has high toughness and high thermal conductivity. Since the steel for a mold has high thermal conductivity, application of a large impact due to local heating to the surface of the mold is less likely to occur. Thus, by having high toughness and high thermal conductivity, high thermal shock resistance is obtained.

For example, in the case where the steel for a mold has a high hardness of 58 HRC or more, and further 59 HRC or more through quenching and tempering, the steel for a mold exhibits sufficiently high wear resistance as a mold, particularly as a mold for hot stamping, and can prevent damage to the mold. In a mold for hot stamping, wear is particularly likely to occur in the case where a steel plate to be processed has a large amount of oxides on its surface or is subjected to a plating treatment, but in the case where the mold has a high hardness as described above, wear of the mold can be effectively prevented also in these cases.

On the other hand, in the case where the composition of the steel for a mold provides excessively high hardness, such as the case where a large amount of C is contained, the toughness of the mold is likely to be reduced due to the generation of coarse crystallized carbides. In addition, the thermal conductivity is likely to be reduced. A decrease in toughness and a decrease in thermal conductivity lead to a decrease in thermal shock resistance of the mold. Therefore, from the viewpoint of ensuring the thermal shock resistance by improving the toughness and the thermal conductivity, the hardness of the steel for a mold is preferably limited to 61 HRC or less in a state after quenching and tempering. As a result, for example, a high thermal conductivity such as 20 W/(m·K) or more is obtained in a state after quenching and tempering, and excellent thermal shock resistance is obtained in the steel for a mold due to both effects of improving the toughness and improving the thermal conductivity. When molding is performed using a mold under conditions involving heating, such as hot stamping, the temperature of the mold surface instantaneously increases during molding, and a thermal load (thermal shock) is likely to be applied to the mold surface. However in the case where the mold has a high thermal shock resistance, occurrence of cracks in the mold due to the thermal shock can be prevented. Therefore, from the viewpoint of avoiding damage during molding, a mold, such as a hot stamping mold, which has a large mechanical load and a large thermal load should include a material having excellent thermal shock resistance in addition to wear resistance.

In this way, setting the component composition of the steel for a mold such that the hardness does not become too high is a good index for improving the thermal shock resistance in terms of both the improvement of the toughness and the improvement of the thermal conductivity. Further, by setting the component composition such that P1 and P2 determined by the above-mentioned formula (1) and formula (2) take values in a predetermined range, the thermal shock resistance of the steel for a mold can be effectively improved. That is, in the case where satisfying P1≥24, a high effect is obtained in improving the thermal conductivity. In addition, in the case where satisfying 4.9≤P2≤7.3, a high effect is obtained in improving the toughness by preventing the generation of coarse crystal grains. By combining these effects, excellent thermal shock resistance is obtained. Further, in the steel for a mold, the contents of Ni and Cu included as inevitable impurities are limited to predetermined upper limits or less, which also contributes to the improvement of thermal shock resistance by ensuring high thermal conductivity. In addition, the contents of Al and S included as inevitable impurities are limited to the predetermined upper limits or less, which also contributes to the improvement of thermal shock resistance by preventing the generation of coarse inclusions.

From the viewpoint of improving the toughness, the steel for a mold according to the present embodiment preferably has a crystal grain size of 5 or more, more preferably 7 or more, and even more preferably 9 or more as defined in JIS G 0551:2020 in a state after quenching. The crystal grain size may be evaluated by, for example, polishing and corroding a cross section of the steel for a mold after quenching, and measuring an average grain size of the crystal grains. In addition, in the steel for a mold, the grain size of the crystallized carbide may be less than 25 μm in a state after quenching and tempering. As a result, an effect of improving the toughness by preventing the generation of coarse crystallized carbides is obtained at a high level. The grain size of the crystallized carbides is more preferably less than 20 μm. The grain size of the crystallized carbides may be evaluated as the maximum value of a diameter of the crystallized carbides generated in the cross section after appropriately corroding the cross section of the steel for a mold subjected to quenching and tempering. Further, as described above, the steel for a mold preferably has a thermal conductivity of 20 W/(m·K) or more, and more preferably has a thermal conductivity of 24 W/(m·K) or more in a state after quenching and tempering.

As described above, the steel for a mold according to the present embodiment includes a predetermined component composition, thereby achieving both high wear resistance and high thermal shock resistance. These characteristics are achieved while reducing contents of expensive additive alloy elements such as Mo and W, thereby reducing the material cost of the steel for a mold. In addition, when manufacturing the mold, it is not necessary to use a manufacturing method with a high manufacturing cost, such as powder molding.

The steel for a mold according to the present embodiment can be exemplified by a form in which, as preferable heat treatment conditions from the viewpoint of achieving the above-described high hardness and high thermal conductivity and the prevention of generation of coarse crystal grains and coarse crystallized carbides, a steel material after melting and casting is forged appropriately, and is subjected to soaking at 1,030° C.±20° C. for 45 minutes±15 minutes, quenching by cooling at a cooling rate of 9° C./min to 100° C./min, and further tempering at 500° C. to 600° C. Further, from the viewpoint of reducing the generation of crystallized carbides, it is preferable to perform soaking treatment at 1,150° C. or higher before forging. The contents of Al, Ni, S, and Cu as inevitable impurities can be adjusted by, for example, the stirring time at the time of refining. By allowing these impurity elements included in a molten metal to escape to an upper portion of the molten metal, a reduction in the content is achieved.

Since the steel for a mold according to the present embodiment exhibits high wear resistance and high thermal shock resistance, the steel for a mold according to the present embodiment can be suitably applied to a mold for an application in which a large mechanical load is applied under high temperature conditions, such as warm molding, hot stamping, warm trimming, and piercing. In particular, the present invention is preferably applied to a mold for hot stamping. However, the present invention is not limited thereto, and can be used to form molds for various applications such as molding of a resin or a rubber material.

EXAMPLES

Hereinafter, the present invention will be described in more detail with reference to examples.

[Preparation of Sample]

Steels for a mold each having the component compositions shown in Tables 1 and 2 were prepared. Specifically, steels each having respective composition ratios were melted in a vacuum induction furnace, and then ingots were cast. The obtained ingots were hot forged, and then subjected to a soaking treatment at 1,150° C. to be subjected to respective tests.

[Test Method]

Hereinafter, each test method will be described. Unless otherwise specified, each evaluation is performed at room temperature in the air.

<Hardness Measurement>

An alloy of each sample was subjected to soaking at 1,030° C. for 60 minutes, and then cooled at a rate of 9° C./min to be quenched. Thereafter, tempering, in which soaking was performed at 500° C. to 600° C. for 1 hour and then air cooling was performed, was performed twice. Then, a test piece of 10 mm×12 mm was collected. After cutting a cross section of the test piece, the cut surface was planarly polished, and the hardness was measured at room temperature by Rockwell C scale (HRC). The hardness exhibiting the highest value in the range of the tempering temperature of 500° C. to 600° C. was recorded. In the case where the hardness is 58 HRC or more and 61 HRC or less, it can be evaluated that the hardness is in a suitable range.

<Evaluation of Grain Size of Crystallized Carbide>

The grain size of the crystallized carbide was evaluated using the test piece after the hardness measurement. In the evaluation, the cross section of the sample was corroded with a corrosive solution and then observed under a microscope. Ten fields of view were observed at a magnification of 200 times, and the grain size of the crystallized carbide was measured in an observation field of view of total 15 $mm^2$. In an estimation of the grain size, the crystallized carbide observed in white in an observation image was emphasized by binarization, and the grain size of the crystallized carbide was evaluated as an equivalent circle diameter. Then, the maximum value of the grain size of the crystallized carbide in the observation image was recorded. In the case where the maximum value of the obtained grain size is less than 25 μm, it can be considered that the generation of coarse crystallized carbides is sufficiently prevented.

<Measurement of Thermal Conductivity>

A region of a diameter of 10 mm×2 mm was cut out from a remaining material for the hardness measurement to obtain a test piece for measurement of thermal conductivity. The thermal conductivity of the test piece was measured by a laser flash method. In the case where the thermal conductivity is 20 W/(m·K) or more, it can be evaluated that the thermal conductivity is sufficiently high.

<Evaluation of Crystal Grain Size>

Each test piece was subjected to soaking at 1,050° C. for 5 hours, and then cooled at a rate of 30° C./min to be quenched. The cross section of the test piece was cut, polished, and corroded, and a region having an area of 450 $mm^2$ was observed with a microscope. An average grain size in that region was evaluated in terms of the grain size number specified in JIS G 0551:2020 of "method for testing austenite crystal grain size for steel", and presence or absence of coarsening of crystal grains due to quenching was evaluated. In the case where the obtained crystal grain size is 5 or more in terms of the grain size number, it can be evaluated that the generation of coarse crystal grains is sufficiently prevented.

<Evaluation of Wear Resistance>

In order to evaluate the wear resistance of the steel for a mold, a block-shaped punch of 30 mm×60 mm×50 mm was prepared as a member simulating a mold using the steel for a mold of each sample. The punch was quenched and tempered under a condition under which the highest hardness was obtained in the hardness measurement test. As illustrated in FIG. 1, a heated steel plate 3 was subjected to hat bending using a punch 1 obtained through quenching and tempering and a die 2. The wear resistance of the punch 1 was evaluated by an acceleration test in which a clearance between the punch 1 and the die 2 was set to −15%. As the steel plate 3 to be processed, a hot stamped steel plate which had a plate thickness of 1.2 mm and was heated to 980° C. was used. An oxide was formed on a surface of the steel plate 3. The steel plate 3 was not subjected to a plating treatment. A plurality of times of processing was performed while replacing the steel plate 3, and when the punch 1 was worn to such an extent as to cause a problem in press processing by processing within 90 shots, the wear resistance was evaluated to be "C", that is, the wear resistance was low. On the other hand, when the punch 1 is worn but no problem is caused in the press processing, the wear resistance was evaluated to be "A", that is, the wear resistance was high. Further, when almost no visually recognizable wear occurred in the punch 1, the wear resistance was evaluated to be "AA", that is, the wear resistance was particularly high.

<Evaluation of Thermal Shock Resistance>

Each test piece was cut into a size of a diameter of 15.5 mm×15.5 mm, and subjected to a quenching and tempering treatment under the same conditions as those in the evaluation of the wear resistance to prepare a test piece. The thermal shock resistance of the obtained test piece was evaluated by repeating application of a thermal load with a process of heating the surface thereof by high-frequency heating and then performing water cooling as one cycle. In the case where a large crack was generated up to 200 cycles, the thermal shock resistance was evaluated to be "C", that is, the thermal shock resistance was low. On the other hand, in the case where only a minor crack was generated, the thermal shock resistance was evaluated to be "A", that is, the thermal shock resistance was high. Further, in the case where no crack was generated, the thermal shock resistance was evaluated to be "AA", that is, the thermal shock resistance was particularly high.

[Test Results]

Tables 1 and 2 show component compositions of each steels for a mold according to respective examples and comparative examples, values of P1 and P2 calculated based on the component compositions, and results of respective tests described above.

TABLE 1

| | | Component Composition (% by mass) | | | | | | | | | | | |
|---|---|---|---|---|---|---|---|---|---|---|---|---|---|
| | | C | Si | Mn | Cr | Mo + W/2 | V | N | Ni | Al | S | Cu | Other Elements |
| Example | 1 | 0.65 | 0.50 | 1.04 | 6.47 | 1.36 | 0.56 | 0.046 | 0.13 | 0.010 | 0.0014 | 0.05 | |
| | 2 | 0.65 | 0.49 | 0.63 | 6.07 | 1.30 | 0.74 | 0.079 | 0.12 | 0.008 | 0.0011 | 0.04 | |
| | 3 | 0.60 | 0.51 | 0.66 | 5.78 | 1.47 | 0.61 | 0.073 | 0.17 | 0.009 | 0.0011 | 0.06 | |
| | 4 | 0.68 | 0.50 | 1.18 | 6.26 | 1.40 | 0.77 | 0.036 | 0.17 | 0.010 | 0.0009 | 0.06 | |
| | 5 | 0.60 | 0.35 | 0.62 | 5.98 | 1.50 | 0.67 | 0.016 | 0.19 | 0.009 | 0.0011 | 0.07 | |
| | 6 | 0.66 | 0.32 | 0.79 | 6.02 | 1.28 | 0.67 | 0.033 | 0.17 | 0.018 | 0.0009 | 0.05 | |
| | 7 | 0.61 | 0.49 | 0.56 | 6.02 | 1.49 | 0.76 | 0.019 | 0.11 | 0.011 | 0.0010 | 0.06 | |
| | 8 | 0.65 | 0.54 | 1.07 | 6.46 | 1.22 | 0.73 | 0.035 | 0.19 | 0.010 | 0.0009 | 0.05 | |
| | 9 | 0.64 | 0.36 | 0.94 | 6.41 | 1.45 | 0.68 | 0.075 | 0.06 | 0.016 | 0.0010 | 0.06 | |
| | 10 | 0.68 | 0.33 | 0.62 | 6.49 | 1.43 | 0.67 | 0.020 | 0.11 | 0.019 | 0.0009 | 0.07 | |
| | 11 | 0.61 | 0.44 | 0.94 | 6.87 | 1.42 | 0.65 | 0.029 | 0.14 | 0.005 | 0.0012 | 0.08 | |
| | 12 | 0.56 | 0.55 | 0.69 | 6.09 | 1.40 | 0.61 | 0.024 | 0.17 | 0.010 | 0.0012 | 0.06 | |
| | 13 | 0.58 | 0.49 | 0.88 | 6.03 | 1.46 | 0.64 | 0.014 | 0.11 | 0.015 | 0.0013 | 0.08 | |
| | 14 | 0.65 | 0.34 | 1.18 | 5.88 | 1.44 | 0.58 | 0.085 | 0.15 | 0.007 | 0.0007 | 0.05 | |
| | 15 | 0.64 | 0.57 | 0.82 | 6.17 | 1.27 | 0.55 | 0.058 | 0.12 | 0.014 | 0.0009 | 0.07 | |
| | 16 | 0.63 | 0.56 | 1.07 | 6.72 | 1.39 | 0.73 | 0.079 | 0.11 | 0.015 | 0.0009 | 0.06 | |
| | 17 | 0.62 | 0.47 | 0.91 | 5.87 | 1.60 | 0.73 | 0.013 | 0.15 | 0.018 | 0.0007 | 0.02 | |
| | 18 | 0.59 | 0.49 | 1.07 | 6.80 | 1.46 | 0.59 | 0.016 | 0.12 | 0.009 | 0.0008 | 0.07 | |
| | 19 | 0.69 | 0.37 | 0.67 | 6.53 | 1.26 | 0.65 | 0.005 | 0.16 | 0.018 | 0.0009 | 0.06 | |
| | 20 | 0.62 | 0.42 | 0.86 | 6.63 | 1.24 | 0.68 | 0.097 | 0.13 | 0.006 | 0.0009 | 0.09 | |
| | 21 | 0.57 | 0.35 | 1.15 | 6.07 | 1.45 | 0.65 | 0.015 | 0.17 | 0.009 | 0.0012 | 0.09 | |
| | 22 | 0.69 | 0.51 | 0.99 | 5.77 | 1.34 | 0.72 | 0.052 | 0.11 | 0.017 | 0.0009 | 0.03 | Nb: 0.16 |
| | 23 | 0.63 | 0.31 | 0.79 | 6.81 | 1.57 | 0.69 | 0.056 | 0.16 | 0.005 | 0.0011 | 0.04 | Co: 0.87 |
| | 24 | 0.62 | 0.42 | 0.75 | 6.28 | 1.36 | 0.57 | 0.039 | 0.12 | 0.011 | 0.0010 | 0.06 | Nb: 0.11<br>Co: 0.74 |

| | | | | Evaluation Result | | | | | |
|---|---|---|---|---|---|---|---|---|---|
| | | P1 | P2 | Hardness (HRC) | Maximum Size of Crystallized Carbide (μm) | Thermal Conductivity (W/(m · K)) | Crystal Grain Size | Wear Resistance | Thermal shock Resistance |
| Example | 1 | 27.0 | 5.2 | 60.4 | 21.8 | 20.9 | 6.1 | A | A |
| | 2 | 27.6 | 7.0 | 60.0 | 20.2 | 22.5 | 9.5 | A | A |
| | 3 | 25.5 | 6.0 | 59.4 | 17.9 | 23.1 | 9.2 | A | A |
| | 4 | 26.4 | 6.7 | 60.5 | 22.2 | 24.6 | 8.2 | A | A |
| | 5 | 27.3 | 5.6 | 58.5 | 14.1 | 25.5 | 8.6 | A | A |
| | 6 | 29.5 | 6.2 | 58.8 | 15.7 | 28.7 | 8.7 | A | AA |
| | 7 | 26.5 | 6.4 | 59.5 | 18.2 | 26.8 | 6.9 | A | A |
| | 8 | 26.7 | 6.4 | 60.7 | 23.0 | 28.0 | 7.8 | AA | AA |
| | 9 | 29.3 | 6.8 | 59.2 | 17.2 | 21.6 | 8.0 | A | A |
| | 10 | 29.1 | 6.0 | 59.5 | 18.4 | 27.7 | 7.6 | A | A |
| | 11 | 27.2 | 5.4 | 59.9 | 20.0 | 27.9 | 7.4 | A | A |

TABLE 1-continued

| | | | | | | | | |
|---|---|---|---|---|---|---|---|---|
| 12 | 25.5 | 5.2 | 59.6 | 18.4 | 23.6 | 7.7 | A | A |
| 13 | 26.7 | 5.5 | 59.3 | 17.3 | 25.6 | 6.8 | A | A |
| 14 | 28.4 | 5.9 | 58.7 | 15.2 | 28.2 | 6.7 | A | AA |
| 15 | 26.8 | 5.5 | 60.5 | 22.1 | 21.3 | 5.8 | AA | A |
| 16 | 26.3 | 7.2 | 60.8 | 23.3 | 22.4 | 8.0 | AA | A |
| 17 | 25.5 | 6.3 | 59.4 | 17.8 | 22.5 | 7.8 | A | A |
| 18 | 26.4 | 5.0 | 60.0 | 20.4 | 22.8 | 6.4 | A | A |
| 19 | 29.0 | 5.6 | 59.9 | 20.0 | 27.7 | 5.6 | A | A |
| 20 | 29.0 | 6.8 | 59.6 | 18.8 | 24.7 | 6.3 | A | A |
| 21 | 28.0 | 5.4 | 58.2 | 13.1 | 26.5 | 7.2 | A | A |
| 22 | 27.2 | 6.8 | 60.3 | 21.5 | 24.4 | 8.0 | A | A |
| 23 | 27.7 | 6.2 | 59.1 | 16.7 | 29.0 | 8.6 | A | AA |
| 24 | 28.1 | 5.3 | 59.3 | 17.6 | 27.1 | 7.6 | A | A |

TABLE 2

| | | Component Composition (% by mass) | | | | | | | | | | | |
|---|---|---|---|---|---|---|---|---|---|---|---|---|---|
| | | C | Si | Mn | Cr | Mo + W/2 | V | N | Ni | Al | S | Cu | Other Elements |
| Comparative Example | 1 | 0.48 | 0.50 | 0.97 | 6.06 | 1.32 | 0.66 | 0.011 | 0.15 | 0.008 | 0.0011 | 0.04 | |
| | 2 | 0.79 | 0.41 | 1.04 | 6.23 | 1.35 | 0.63 | 0.016 | 0.10 | 0.014 | 0.0012 | 0.08 | |
| | 3 | 0.59 | 0.22 | 0.73 | 6.51 | 1.54 | 0.66 | 0.013 | 0.17 | 0.016 | 0.0012 | 0.04 | |
| | 4 | 0.69 | 0.81 | 0.86 | 6.30 | 1.39 | 0.42 | 0.036 | 0.18 | 0.014 | 0.0011 | 0.04 | |
| | 5 | 0.63 | 0.45 | 0.35 | 5.86 | 1.33 | 0.70 | 0.007 | 0.11 | 0.005 | 0.0010 | 0.05 | |
| | 6 | 0.67 | 0.55 | 0.75 | 5.13 | 1.55 | 0.69 | 0.016 | 0.14 | 0.013 | 0.0008 | 0.09 | |
| | 7 | 0.56 | 0.45 | 0.91 | 6.17 | 0.95 | 0.66 | 0.006 | 0.16 | 0.014 | 0.0011 | 0.07 | |
| | 8 | 0.65 | 0.45 | 0.86 | 6.06 | 1.92 | 0.89 | 0.022 | 0.17 | 0.013 | 0.0009 | 0.04 | |
| | 9 | 0.67 | 0.48 | 0.67 | 6.43 | 1.41 | 0.59 | 0.002 | 0.38 | 0.011 | 0.0012 | 0.09 | |
| | 10 | 0.68 | 0.69 | 1.00 | 6.70 | 1.67 | 0,69 | 0.244 | 0.15 | 0.018 | 0.0006 | 0.09 | |
| | 11 | 0.59 | 0.77 | 0.94 | 6.76 | 1.31 | 0.64 | 0.071 | 0.25 | 0.043 | 0.0009 | 0.04 | |
| | 12 | 0.60 | 0.35 | 1.02 | 5.89 | 1.77 | 0.47 | 0.003 | 0.32 | 0.014 | 0.0010 | 0.06 | |
| | 13 | 0.65 | 0.72 | 1.00 | 5.89 | 1.85 | 0.92 | 0.165 | 0.34 | 0.013 | 0.0011 | 0.07 | |
| | 14 | 0.61 | 0.49 | 0.85 | 6.32 | 1.25 | 0.85 | 0.048 | 0.12 | 0.037 | 0.0013 | 0.05 | |
| | 15 | 0.62 | 0.46 | 0.86 | 6.51 | 1.36 | 0.66 | 0.216 | 0.13 | 0.042 | 0.0011 | 0.06 | |
| | 16 | 0.63 | 0.57 | 1.09 | 6.71 | 1.30 | 0.93 | 0.289 | 0.13 | 0.055 | 0.0010 | 0.08 | |
| | 17 | 0.64 | 0.47 | 0.91 | 6.01 | 1.48 | 0.71 | 0.017 | 0.16 | 0.020 | 0.0018 | 0.08 | |
| | 18 | 0.63 | 0.49 | 0.94 | 6.05 | 1.45 | 0.69 | 0.013 | 0.14 | 0.018 | 0.0020 | 0.09 | |
| | 19 | 0.63 | 0.48 | 0.91 | 6.05 | 1.44 | 0.69 | 0.015 | 0.13 | 0.020 | 0.0023 | 0.09 | |
| | 20 | 0.61 | 0.51 | 0.93 | 6.02 | 1.29 | 0.68 | 0.022 | 0.17 | 0.017 | 0.0028 | 0.07 | |
| | 21 | 0.62 | 0.58 | 0.97 | 6.41 | 1.53 | 0.64 | 0.014 | 0.15 | 0.013 | 0.0014 | 0.12 | |
| | 22 | 0.60 | 0.56 | 0.95 | 6.33 | 1.55 | 0.66 | 0.018 | 0.19 | 0.015 | 0.0013 | 0.16 | |
| | 23 | 0.59 | 0.57 | 0.98 | 6.37 | 1.56 | 0.63 | 0.018 | 0.18 | 0.012 | 0.0011 | 0.21 | |
| | 24 | 0.64 | 0.51 | 0.94 | 6.10 | 1.47 | 0.67 | 0.015 | 0.14 | 0.020 | 0.0023 | 0.14 | |
| | 25 | 0.65 | 0,55 | 0.89 | 6.21 | 1.52 | 0.71 | 0.012 | 0.19 | 0.014 | 0.0019 | 0.15 | |
| | 26 | 0.66 | 0.57 | 0.93 | 6.30 | 1.55 | 0.67 | 0.014 | 0.18 | 0.018 | 0.0017 | 0.19 | |
| | 27 | 0.69 | 0.59 | 1,19 | 6.88 | 1.58 | 0.78 | 0.090 | 0,19 | 0.018 | 0.0009 | 0.07 | |
| | 28 | 0.65 | 0.59 | 0.99 | 6.44 | 1.57 | 0.69 | 0.080 | 0.18 | 0.016 | 0.0012 | 0.09 | |
| | 29 | 0.56 | 0.31 | 0.55 | 5.74 | 1.22 | 0.56 | 0.005 | 0.01 | 0.005 | 0.0005 | 0.05 | |

| | | | | Evaluation Result | | | | | |
|---|---|---|---|---|---|---|---|---|---|
| | | P1 | P2 | Hardness (HRC) | Maximum Size of Crystallized Carbide (μm) | Thermal Conductivity (W/(m · K)) | Crystal Grain Size | Wear Resistance | Thermal shock Resistance |
| Comparative Example | 1 | 27.1 | 5.4 | 55.9 | 13.6 | 21.6 | 5.5 | C | A |
| | 2 | 28.6 | 5.5 | 62.1 | 28.4 | 21.6 | 6.2 | AA | C |
| | 3 | 29.0 | 5.7 | 56.3 | 11.3 | 29.7 | 6.3 | C | AA |
| | 4 | 21.9 | 4.2 | 60.1 | 27.8 | 17.9 | 3.9 | A | C |
| | 5 | 28.1 | 5.5 | 56.5 | 17.6 | 27.7 | 6.1 | C | A |
| | 6 | 24.8 | 5.9 | 56.6 | 19.5 | 26.9 | 6.3 | C | A |
| | 7 | 30.2 | 5.5 | 56.4 | 15.8 | 27.2 | 6.1 | C | A |
| | 8 | 23.2 | 7.4 | 59.6 | 28.7 | 18.5 | 4.2 | A | C |
| | 9 | 23.7 | 4.8 | 60.4 | 21.8 | 18.9 | 3.8 | A | C |
| | 10 | 22.0 | 9.7 | 60.1 | 26.9 | 17.8 | 4.3 | A | C |
| | 11 | 22.1 | 7.5 | 60.2 | 26.4 | 17.9 | 3.9 | A | C |
| | 12 | 23.7 | 4.1 | 58.4 | 26.7 | 19.2 | 3.7 | A | C |
| | 13 | 17.9 | 9.9 | 60.4 | 28.2 | 17.3 | 4.5 | A | C |
| | 14 | 27.9 | 8.5 | 59.8 | 26.2 | 21.1 | 4.5 | A | C |
| | 15 | 27.5 | 9.9 | 59.9 | 26.8 | 23.6 | 4.6 | A | C |
| | 16 | 26.5 | 13.6 | 60.2 | 30.9 | 22.0 | 3.7 | A | C |
| | 17 | 26.2 | 6.3 | 59.8 | 22.6 | 23.5 | 6.1 | A | C |
| | 18 | 26.4 | 6.0 | 59.4 | 21.9 | 23.2 | 5.8 | A | C |

TABLE 2-continued

| | | | | | | | | |
|---|---|---|---|---|---|---|---|---|
| 19 | 26.7 | 6.1 | 59.6 | 21.7 | 23.1 | 5.9 | A | C |
| 20 | 26.8 | 6.0 | 59.9 | 20.4 | 23.8 | 6.1 | A | C |
| 21 | 24.5 | 5.5 | 59.3 | 20.6 | 19.4 | 5.2 | A | C |
| 22 | 24.1 | 5.7 | 59.8 | 21.0 | 19.2 | 5.6 | A | C |
| 23 | 24.0 | 5.4 | 59.3 | 19.5 | 19.1 | 5.6 | A | C |
| 24 | 26.0 | 6.0 | 59.8 | 20.1 | 19.6 | 5.7 | A | C |
| 25 | 24.4 | 6.0 | 60.2 | 22.3 | 19.4 | 5.9 | A | C |
| 26 | 24.1 | 5.9 | 60.5 | 20.7 | 19.3 | 5.7 | A | C |
| 27 | 23.5 | 7.9 | 60.9 | 23.6 | 19.4 | 4.7 | A | C |
| 28 | 23.7 | 7.0 | 60.5 | 21.4 | 19.5 | 6.4 | A | C |
| 29 | 32.1 | 4.4 | 58.5 | 21.5 | 29.6 | 3.6 | A | C |

<Content of Each Component Element and Characteristics of Steel for a Mold>

The steel for a mold according to each example shown in Table 1 includes the component composition specified in the present disclosure described above. The values of P1 and P2 also exist in a predetermined range. Each of the steels for a mold according to the respective examples has a hardness of 58 HRC or more and 61 HRC or less, a thermal conductivity of 20 W/(m·K) or more, and a grain size number of 5 or more. In addition, the grain size of the maximum crystallized carbide is limited to less than 25 μm. Further, in response to these characteristics, high evaluation results are obtained in the wear resistance test and the thermal shock resistance test.

When the respective examples are compared, there is a high correlation between the hardness and the wear resistance, and particularly high wear resistance (AA) is obtained in each example in which the hardness exceeds 60.5 HRC. In general, in examples in which the content of an element that exhibits an effect of improving the hardness, such as C, Si, Cr, Mo, and W, is large, a tendency to exhibit high hardness is confirmed. On the other hand, in each sample having a thermal conductivity of approximately 28 W/(m·K), particularly high thermal shock resistance (AA) is obtained. As will be described in detail later with reference to FIG. 2, there is a high correlation between P1 and the thermal conductivity, and high thermal conductivity tends to be obtained in a region where the value of P1 is large.

On the other hand, the steel for a mold according to each comparative example shown in Table 2 does not include the component composition specified in the present disclosure described above. Correspondingly, high wear resistance and high thermal shock resistance are not achieved at the same time. Among the respective comparative examples, in Comparative Examples 1 to 16, an individual content of each essentially included element is out of the predetermined range. Among those, the relationship between the content of each element and the characteristics will be described by taking a main comparative example as an example.

In Comparative Example 1, the content of C was too small. Correspondingly, the hardness did not reach 58 HRC, and the wear resistance was low. On the other hand, in Comparative Example 2, the content of C was too large. Correspondingly, the hardness exceeded 61 HRC, and crystallized carbides having a grain size of 25 μm or more were generated, and the thermal shock resistance was also low.

In Comparative Example 3, the content of Si was too small. Correspondingly, the hardness did not reach 58 HRC, and the wear resistance was low. On the other hand, in Comparative Example 4, the content of Si was too large. Correspondingly, the thermal conductivity did not reach 20 W/(m·K), and the thermal shock resistance was also low.

In Comparative Examples 5, 6, and 7, the contents of Mn, Cr, and Mo+W/2 were too small, respectively. Correspondingly, in any of these samples, the hardness did not reach 58 HRC, and the wear resistance was low. On the other hand, in Comparative Example 8, the content of Mo+W/2 was too large. Correspondingly, crystallized carbides having a grain size of 25 μm or more were generated, and the thermal conductivity did not reach 20 W/(m·K). As a result, the thermal shock resistance was low.

In Comparative Example 9, the content of N was too small. Correspondingly, the crystal grain size was less than 5, and the thermal shock resistance was low. On the other hand, in Comparative Example 10, the content of N was too large. In this case as well, the crystal grain size was rather less than 5. Crystallized carbides having a grain size of 25 μm or more were also generated. As a result, the thermal shock resistance was also low.

In Comparative Example 12, the content of V was too small. Correspondingly, the crystal grain size was less than 5, and the thermal shock resistance was also low. On the other hand, in Comparative Example 13, the content of V was too large. Correspondingly, coarse crystallized carbides having a grain size of 25 μm or more were generated, and the crystal grain size was also less than 5. The thermal shock resistance was also low.

<Relationship Between P1 and Thermal Conductivity>

Figure 2:
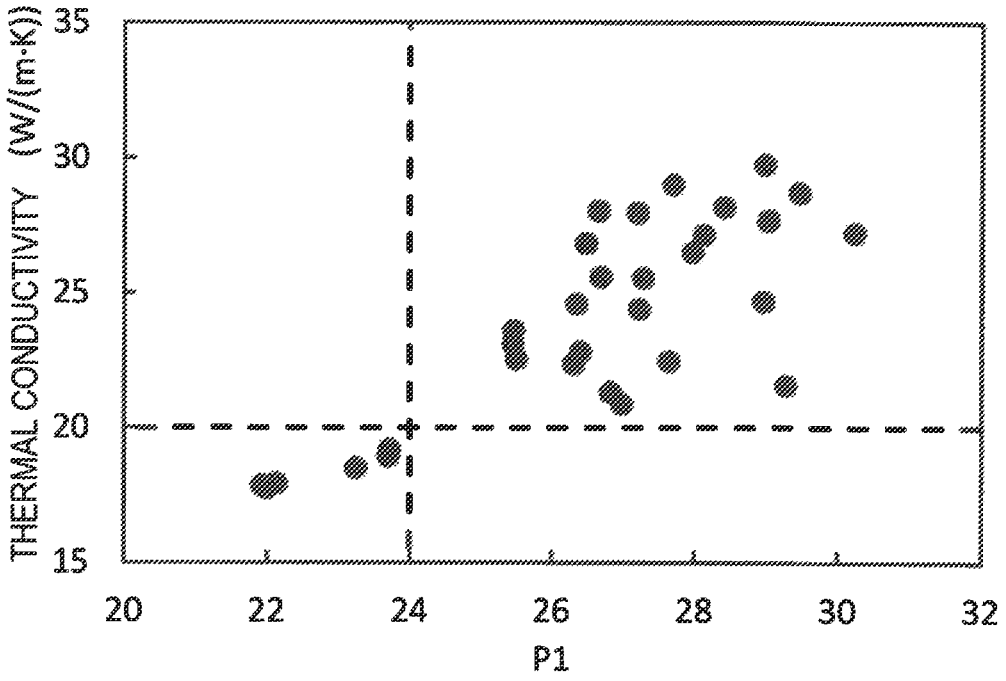
FIG. 2 is a graph showing a relationship between a value of P1 and the thermal conductivity.

Here, the relationship between P1 and the thermal conductivity will be discussed. In FIG. 2, the relationship between P1 and the thermal conductivity is plotted for some comparative examples in addition to the respective examples. Here, as a comparative example shown in FIG. 2, a comparative example in which the content of at least one of Si, Mo, W, and Ni, which are elements included in the definition of P1 in the formula (1), and/or the value of P1 itself is out of a predetermined range is selected. That is, FIG. 2 shows Comparative Examples 3, 4, 7 to 13, 27, and 28 in addition to the respective examples.

According to FIG. 2, there is a correlation between the value of P1 and the thermal conductivity, and although there is a variation, the thermal conductivity tends to increase as P1 increases. This corresponds to a fact that the contents of Si, Mo, W, and Ni that cause a decrease in thermal conductivity contribute to P1 defined by the formula (1) with a negative sign. As indicated by dashed lines in FIG. 2, it can be seen that in the case where P1 is 24 or more, a thermal conductivity of 20 W/(m·K) or more is obtained.

<Relationship Between P2 and Crystal Grain Size>

Figure 3:
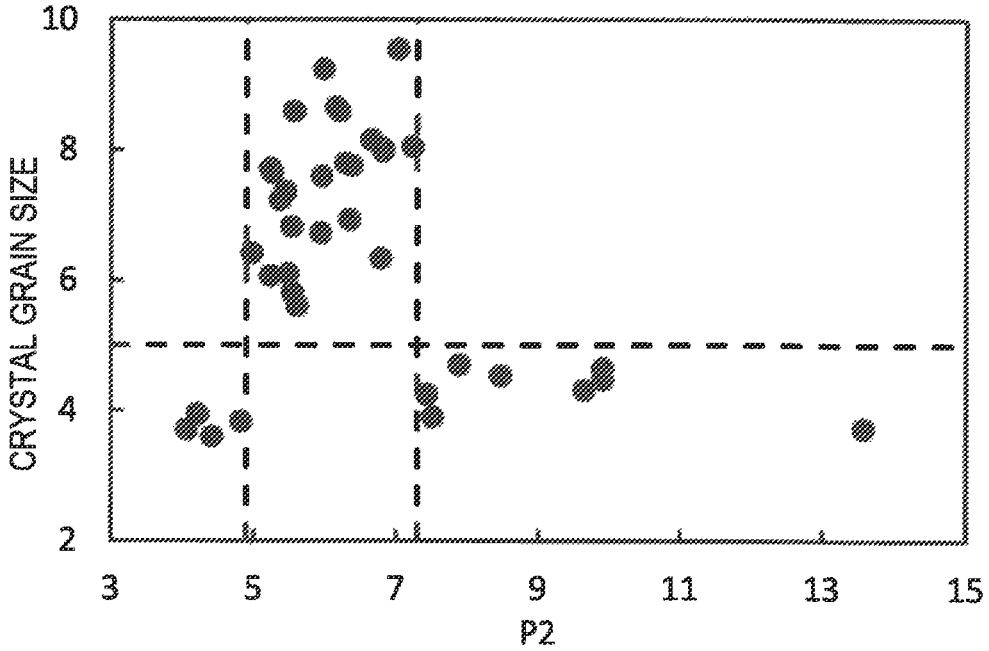
FIG. 3 is a graph showing a relationship between a value of P2 and the crystal grain size.

Next, the relationship between P2 and the crystal grain size will be discussed. In FIG. 3, the relationship between P2 and the crystal grain size is plotted for some comparative examples in addition to the respective examples. Here, as a comparative example shown in FIG. 3, a comparative example in which the content of at least one of V, N, and Al, which are elements included in the definition of P2 in the formula (2), and/or the value of P2 itself is out of a predetermined range is selected. That is, FIG. 3 shows Comparative Examples 4, 7 to 16, 27, and 29 in addition to the respective examples.

According to FIG. 3, there is a correlation between the value of P2 and the crystal grain size, and the crystal grain size is small in a region where P2 is small and a region where P2 is large, whereas the crystal grain size is large in a region where P2 has a medium value. This corresponds to a fact that the contents of V, N, and Al contributing to the generation of the pinning particles are included in P2 defined by the formula (2). In the case where the contents of these elements are too small, pinning particles that contribute to prevention of coarsening of crystal grains are not sufficiently generated, and conversely, even in the case where the contents of these elements are too large, generation of coarse crystal grains proceeds, so that the crystal grain size becomes large in a region where P2 is not too small and is not too large, and the refinement of crystal grains is promoted. As indicated by dashed lines in FIG. 3, it can be seen that the crystal grain size is 5 or more in the case where P2 is in a range of 4.9 or more and 7.3 or less.

<Relationship Between Contents of S and Cu and Thermal Shock Resistance>

Figure 4:
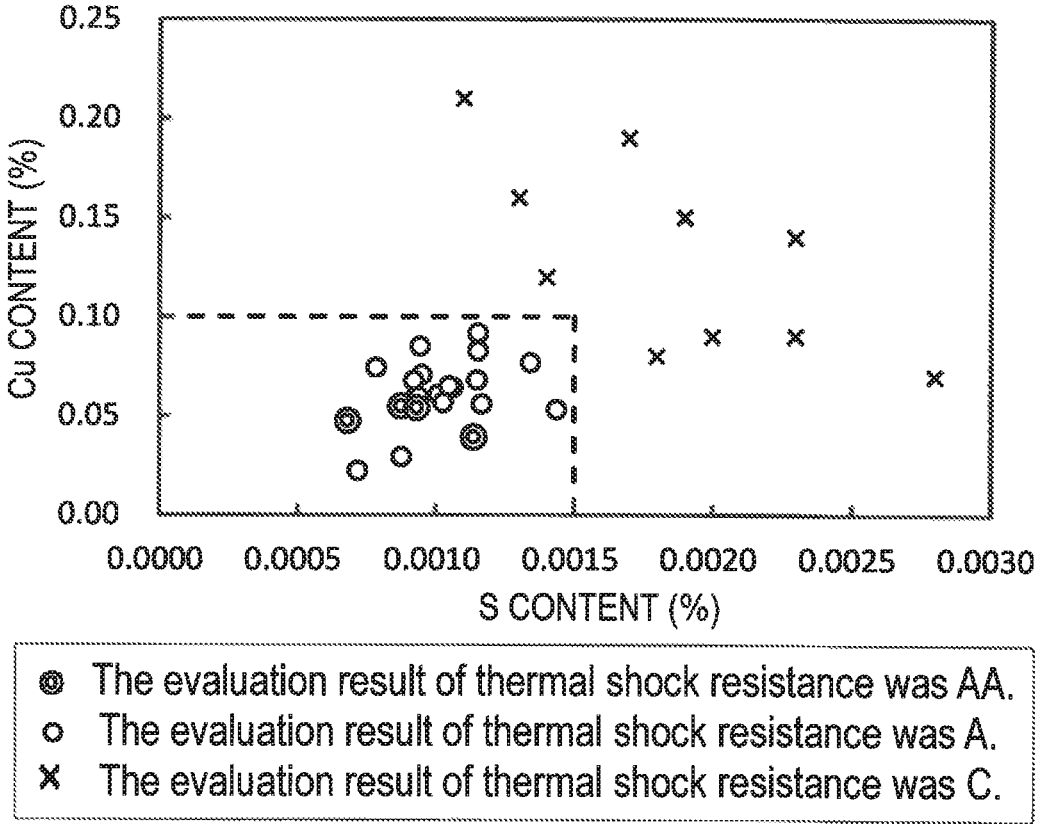
FIG. 4 is a graph showing results of a thermal shock resistance test with respect to concentrations of S and Cu.

Finally, the relationship between the contents of S and Cu included as inevitable impurities and the thermal shock resistance will be discussed. FIG. 4 shows the relationship between the contents of S and Cu and evaluation results of the thermal shock resistance in the respective examples, and respective comparative examples (Comparative Examples 17 to 26) which are comparative examples only in which the content of S and/or Cu exceeds a predetermined upper limit. The content of S is plotted on the horizontal axis, the content of Cu is plotted on the vertical axis, and the evaluation results of thermal shock resistance are indicated by symbols corresponding to AA, A, and C of thermal shock resistance evaluation at corresponding coordinate positions.

According to FIG. 4, points having high thermal shock resistance indicated symbols corresponding A and AA of thermal shock resistance evaluation are concentrated in a lower left region where S≤0.0015% and Cu≤0.10%. In a region where the content of at least one of S and Cu exceeds the range thereof, the symbol corresponding C of thermal shock resistant evaluation is distributed, and the thermal shock resistance is low. Therefore, in the case where the contents of S and Cu are increased, the thermal shock resistance of the steel for a mold is reduced, but in the case where the contents of S and Cu as inevitable impurities are limited to the ranges of S≤0.0015% and Cu≤0.10%, high thermal shock resistance is ensured.

The embodiment and examples of the present invention have been described above. The present invention is not particularly limited to these embodiments and examples, and various modifications can be made.

The present application is based on Japanese Patent Application No. 2022-026456 filed on Feb. 24, 2022, and the contents thereof are incorporated herein by reference.

1: punch
2: die
3: steel plate

What is claimed is:

1. A steel for a mold, having a composition consisting of, on % by mass basis:
0.55%≤C≤0.70%;
0.30%≤Si≤0.60%;
0.55%≤Mn≤1.2%;
5.7%≤Cr≤6.9%;
1.2%≤Mo+W/2≤1.6%;
0.55%≤V≤0.79%;
0.005%≤N≤0.1%,
Nb≤0.5%;
Zr≤0.5%;
Ta≤0.5%; and
Co≤1.0%,
with the remainder being Fe and inevitable impurities satisfying, on % by mass basis, Al≤0.020%, Ni≤0.20%, S≤0.0015%, and Cu≤0.10%, and
satisfying P1≥24 and 4.9≤P2≤7.3, P1 being a value obtained based on the following formula (1) and P2 being a value obtained based on the following formula (2), $$P1=45-13.6[Si]-7.0([Mo]+[W]/2)-12.9[Ni] \quad (1)$$

$$P2=7.4[V]+15.8[N]+38.6[Al] \quad (2)$$

in the formulae (1) and (2), [M] represents a content of an element M in % by mass basis,
wherein in a state after quenching and tempering, the steel has a hardness at room temperature of 58 HRC or more and 61 HRC or less, and a thermal conductivity at room temperature of 20 W/(m·K) or more, and
in a state after quenching, the steel has a crystal grain size of 5 or more in terms of a grain size number defined in JIS G 0551:2020.

2. The steel for a mold according to claim 1,
further satisfying, on % by mass basis, at least one kind selected from the group consisting of:
0.01%≤Nb≤0.5%;
0.01%≤Zr≤0.5%; and
0.01%≤Ta≤0.5%.

3. The steel for a mold according to claim 1, further satisfying, on % by mass basis, 0.10%≤Co≤1.0%.

4. The steel for a mold according to claim 1, wherein in a state after quenching and tempering, the steel has a grain size of a crystallized carbide of less than 25 km.

5. A mold comprising the steel for a mold according to claim 1.

6. The mold according to claim 5, wherein the mold is a hot stamping mold.

7. The steel for a mold according to claim 1, further satisfying, on % by mass basis, 0.55%≤C≤0.63%.

8. The steel for a mold according to claim 1, further satisfying, on % by mass basis, 0.005%≤N≤0.0244%.

* * * * *